US011136217B2

(12) United States Patent
Montigny et al.

(10) Patent No.: US 11,136,217 B2
(45) Date of Patent: Oct. 5, 2021

(54) ELEVATOR ACCESS SYSTEMS FOR ELEVATORS

(71) Applicant: Otis Elevator Company, Farmington, CT (US)

(72) Inventors: Guillaume Montigny, Gien (FR); Gerard Sirigu, Gien (FR); Sebastien Fougeron, Lorris (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 454 days.

(21) Appl. No.: 16/288,236

(22) Filed: Feb. 28, 2019

(65) Prior Publication Data

US 2019/0270612 A1 Sep. 5, 2019

(30) Foreign Application Priority Data

Mar. 1, 2018 (EP) ..... 18305223

(51) Int. Cl.
*B66B 5/00* (2006.01)
*B66B 1/08* (2006.01)
(Continued)

(52) U.S. Cl.
CPC ..... *B66B 5/0062* (2013.01); *B66B 1/08* (2013.01); *B66B 5/0087* (2013.01); *B66B 13/14* (2013.01);
(Continued)

(58) Field of Classification Search
CPC .. B66B 13/20; B66B 5/18; B66B 9/00; B66B 13/12; B66B 13/08; B66B 5/005; B66B 13/16; B66B 13/24; B66B 1/20; B66B 5/0087; B66B 13/22; B66B 13/245; B66B 1/08; B66B 17/34; B66B 1/365; B66B 11/0246; B66B 5/288; B66B 29/00; B66B 5/0043; B66B 5/0056; B66B 5/021; B66B 13/00; B66B 13/125
See application file for complete search history.

(56) References Cited

U.S. PATENT DOCUMENTS 4,228,873 A 10/1980 Nyborg, Jr.
5,407,350 A 4/1995 Iwabuchi et al.
(Continued)

FOREIGN PATENT DOCUMENTS

CN 1100173 A 3/1995
CN 1253367 C 4/2006
(Continued)

OTHER PUBLICATIONS

European Search Report for European Application No. 18305223.2, Filing Date Mar. 1, 2018, Report dated Sep. 7, 2018, 6 pages.

*Primary Examiner* — Marlon T Fletcher
(74) *Attorney, Agent, or Firm* — Cantor Colburn LLP

(57) ABSTRACT

Elevator access systems are provided. The elevator access systems include a bushing having a keyway, a plunger disposed within the bushing and movable relative thereto, a lever operably connected to the plunger, and a removable plug located within the keyway of the bushing, wherein the removable plug urges the plunger and the lever into a first position, and upon removal of the removable plug, the plunger and the lever move to a second position, wherein in the second position the plunger is accessible to operate the lever.

16 Claims, 11 Drawing Sheets

(51) Int. Cl.
*B66B 13/14* (2006.01)
*B66B 13/24* (2006.01)
*B66B 1/34* (2006.01)

(52) U.S. Cl.
CPC ..... *B66B 13/24* (2013.01); *B66B 13/245* (2013.01); *B66B 1/34* (2013.01)

(56) References Cited

U.S. PATENT DOCUMENTS

| | | | | |
|---|---|---|---|---|
| 2010/0155184 | A1* | 6/2010 | Sirigu | B66B 13/22 187/302 |
| 2010/0163346 | A1* | 7/2010 | Coquerelle | B66B 5/18 187/247 |
| 2017/0341909 | A1 | 11/2017 | Fonteneau et al. | |
| 2018/0127237 | A1* | 5/2018 | Fonteneau | B66B 5/0087 |
| 2019/0270612 | A1* | 9/2019 | Montigny | B66B 13/24 |

FOREIGN PATENT DOCUMENTS

| | | | |
|---|---|---|---|
| CN | 101689733 | A | 3/2010 |
| CN | 202609722 | U | 12/2012 |
| CN | 203112307 | U | 8/2013 |
| CN | 103670026 | A | 3/2014 |
| CN | 103818809 | A | 5/2014 |
| CN | 205531731 | U | 8/2016 |
| CN | 205932891 | U | 2/2017 |
| CN | 106853941 | A | 6/2017 |
| EP | 0558299 | A3 | 9/1993 |
| EP | 1728754 | A1 | 12/2006 |
| EP | 3121353 | A1 | 7/2015 |
| EP | 3056460 | A1 | 8/2016 |
| EP | 3230194 | A1 | 10/2017 |
| EP | 3255006 | A2 | 12/2017 |
| FR | 2909650 | A1 | 6/2008 |
| JP | 2000072361 | A | 3/2000 |
| JP | 2003118956 | A | 4/2003 |
| JP | 2003252556 | A | 9/2003 |
| JP | 2005298089 | A | 10/2005 |
| JP | 2006264841 | A | 10/2006 |
| JP | 2006278975 | A | 10/2006 |
| JP | 2009249821 | A | 10/2009 |
| JP | 2015030606 | A | 2/2015 |
| JP | 2016037326 | A | 3/2016 |
| KR | 20060036381 | A | 4/2006 |
| SU | 794169 | A1 | 1/1981 |
| WO | 2004048247 | A1 | 6/2004 |
| WO | 2017009678 | A1 | 1/2017 |
| WO | 2017017702 | A1 | 2/2017 |

* cited by examiner

ELEVATOR ACCESS SYSTEMS FOR ELEVATORS

CROSS REFERENCE TO RELATED APPLICATIONS

This application claims the benefit of European Patent Application No. 18305223.2, filed Mar. 1, 2018, which is incorporated herein by reference in its entirety.

BACKGROUND

The subject matter disclosed herein generally relates to elevator systems and, more particularly, to access systems and devices for locks and access to elevator shafts for elevator maintenance.

Elevator systems include locking mechanisms that are useable by mechanics, technicians, and other authorized persons. The locking mechanisms can be part of lintels or door columns or traps inside the car of the elevator system and thus may be easily accessible by anyone. However, it may be required by safety regulations and/or advantageous to prevent access to and/or operation of the elevator locking mechanisms at certain times (e.g., when a technician or mechanic is performing a maintenance operation) or when authorized access is not proper. Accordingly, devices that prevent access to the elevator system locking mechanisms may be desirable.

SUMMARY

According to some embodiments, elevator access systems are provided. The elevator access systems include a bushing having a keyway, a plunger disposed within the bushing and movable relative thereto, a lever operably connected to the plunger, and a removable plug located within the keyway of the bushing, wherein the removable plug urges the plunger and the lever into a first position, and upon removal of the removable plug, the plunger and the lever move to a second position, wherein in the second position the plunger is accessible to operate the lever.

In addition to one or more of the features described above, or as an alternative, further embodiments of the elevator access systems may include an elevator safety chain switch, wherein when the plunger moves from the first position to the second position, the elevator safety chain switch is actuated to break an elevator safety chain.

In addition to one or more of the features described above, or as an alternative, further embodiments of the elevator access systems may include a switch cover arranged to mount the elevator safety chain switch to the bushing.

In addition to one or more of the features described above, or as an alternative, further embodiments of the elevator access systems may include that the plunger has a contact surface and the elevator safety chain switch has a switch arm, wherein as the plunger moves from the first position to the second position, the contact surface contacts the switch arm to actuate the elevator safety chain switch.

In addition to one or more of the features described above, or as an alternative, further embodiments of the elevator access systems may include a biasing element operably connected to the lever, wherein the biasing element is arranged to urge the lever toward the second position.

According to some embodiments, elevator systems are provided that include the elevator access system of any embodiment described herein.

In addition to one or more of the features described above, or as an alternative, further embodiments of the elevator systems may include that the bushing is installed in a landing door lintel of the elevator system.

In addition to one or more of the features described above, or as an alternative, further embodiments of the elevator systems may include a landing door lock having a lock pin, wherein the lever is arranged to contact the lock pin when in the second position.

In addition to one or more of the features described above, or as an alternative, further embodiments of the elevator systems may include a rail, wherein when the lever is in the first position, the rail blocks rotational movement of the lever.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
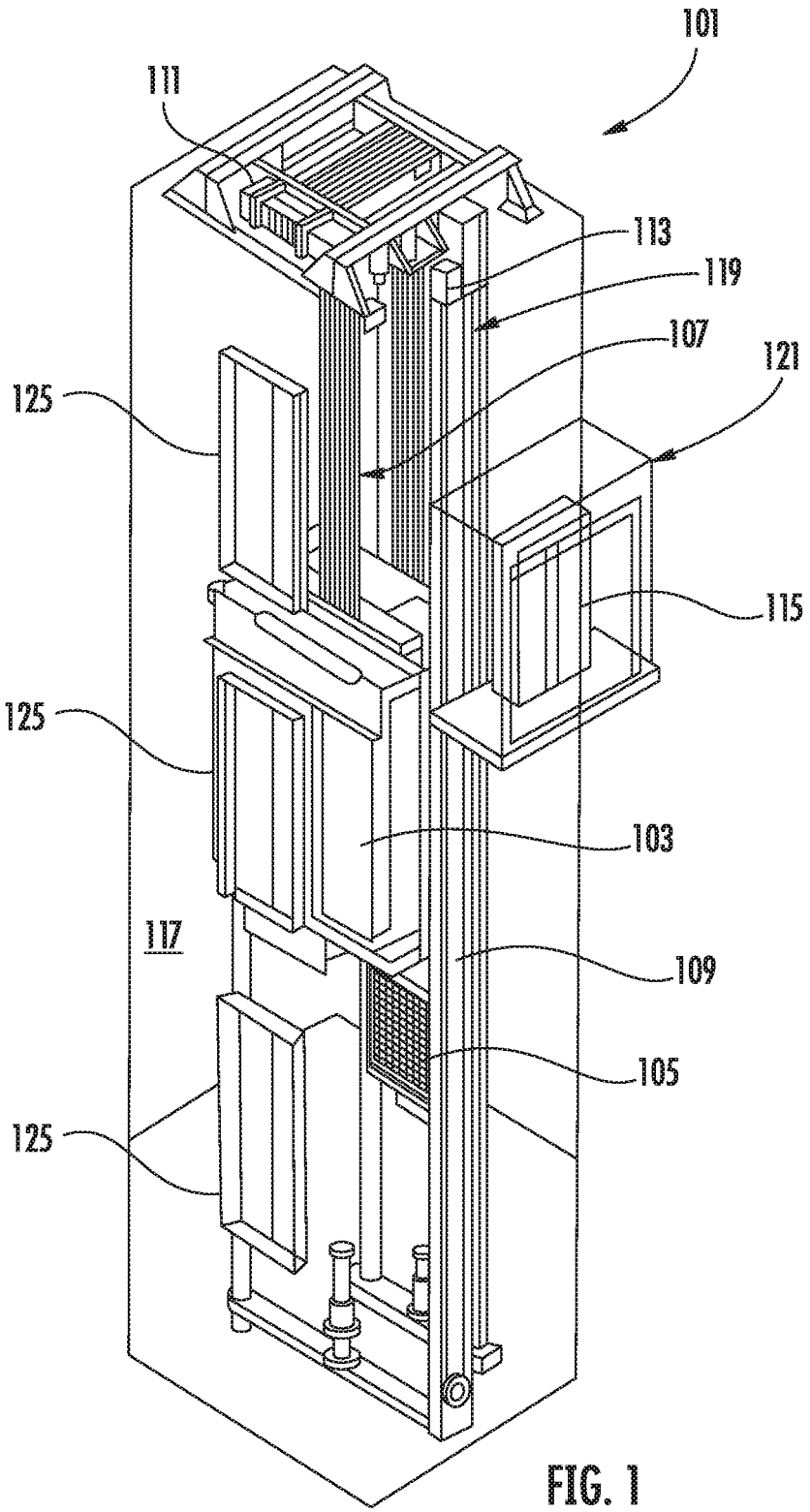
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which, in this illustrative embodiment, is part of an overhead structure of the elevator system 101, although other arrangements are possible without departing from the scope of the present disclosure. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown in the illustrative arrangement, in a controller room 121 of the elevator shaft 117 and is configured to control the operation of the elevator system 101, and particularly the elevator car 103. In other embodiments the controller 115 can be located in other locations, including, but not limited to, fixed to a landing or landing door or located in a cabinet at a landing. The elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
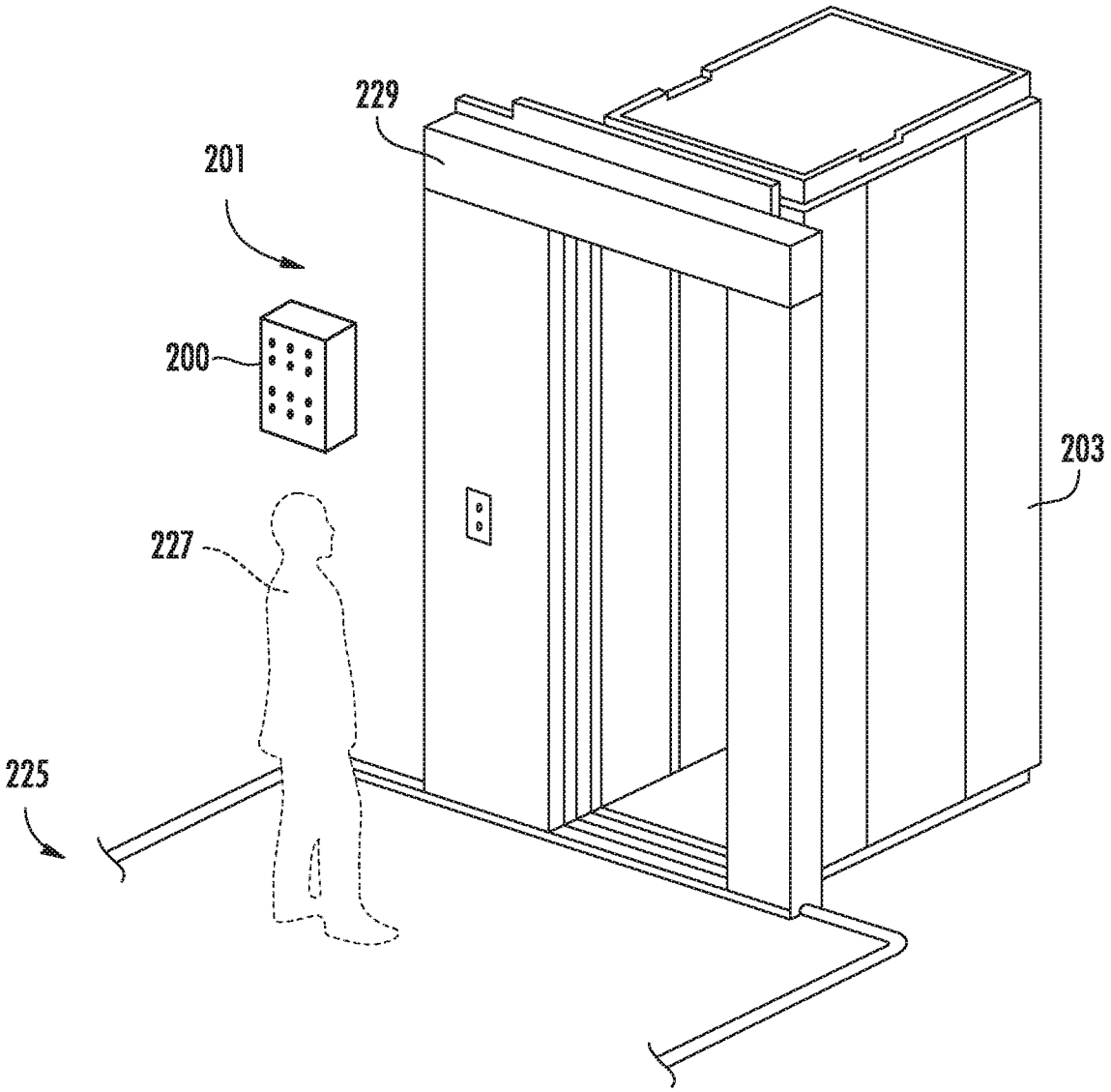
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on a portion of the elevator system 201. In some situations, the mechanic 227 may wish to lock a feature of the elevator system, e.g., the elevator doors, an elevator trap, etc., such that the feature(s) cannot be opened or closed (e.g., to prevent unauthorized persons from accessing the elevator system 201 or portions thereof). For example, such situation may arise when the mechanic 227 wishes to access the elevator car and/or shaft to perform maintenance. Such control or locking can be achieved by a lock hole in a landing door lintel 229 of the elevator system 201 (which may be located at one or more landings 225). It may be advantageous to prevent unauthorized persons from accessing the lock and also enable access in a controlled manner. Accordingly, embodiments provided herein are directed to access systems and devices to enable locking/unlocking locks of elevator systems, the access systems securely preventing unauthorized access to the locks of the elevator system.

For example, in some configurations, an access control module 200 (e.g., an emergency and inspection cabinet) can be located at one or more landings 225 of the elevator system. The access control module 200 can include one or more electrical and/or mechanical components that are configured to enable control of and/or access to an associated elevator system. For example, the access control module 200 can include a specialized or unique access key or tool ("access device") for a mechanic or other authorized person to lock and unlock various locks of the elevator system (e.g., lintel door locks, etc.). The access control module 200 can thus enable a mechanic or other authorized person (e.g., emergency personnel) to access an elevator shaft or car for various reasons (e.g., open landing doors).

Figure 3:
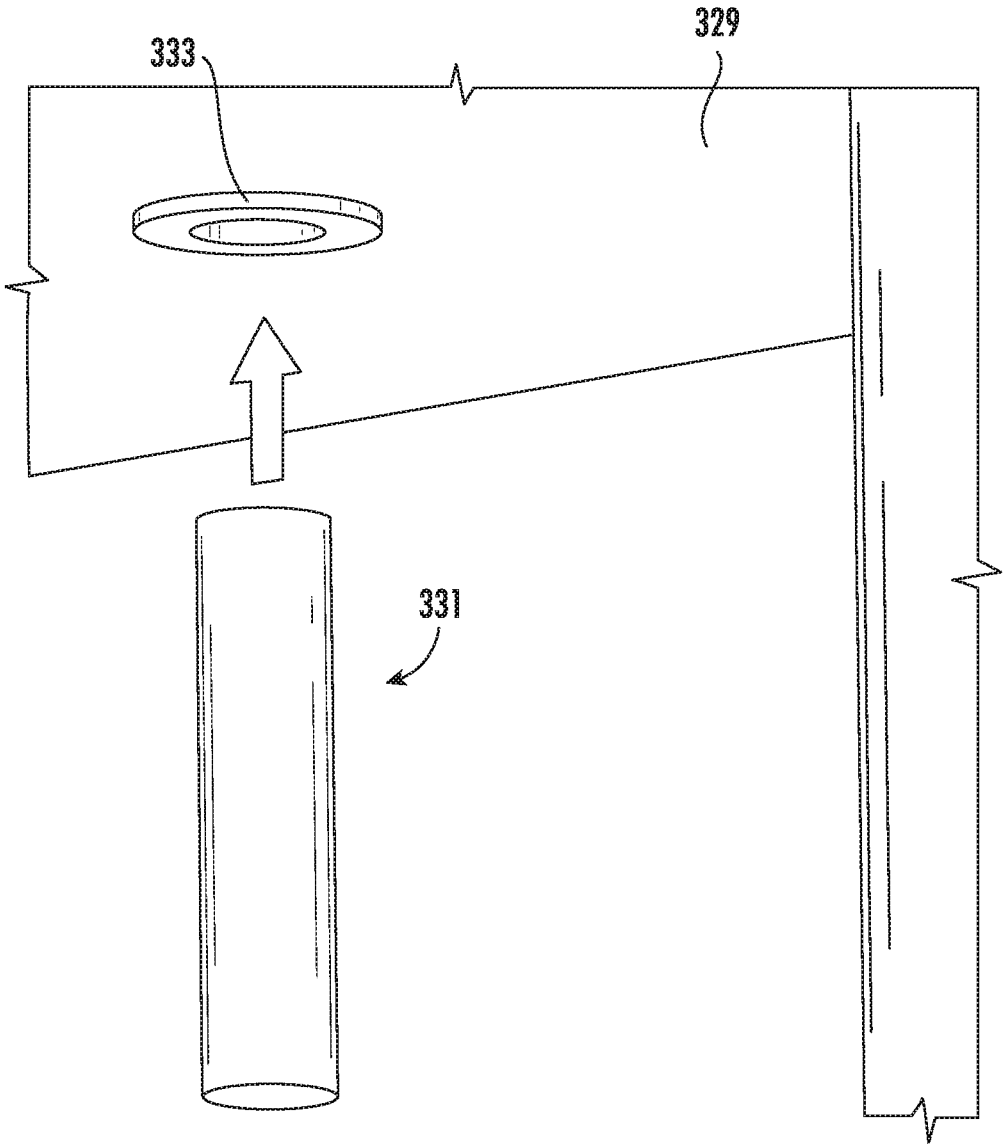
FIG. 3 is a schematic illustration of a lock of an elevator system that can incorporate embodiments of the present disclosure.

Turning to FIG. 3, an access device 331 for use with a lock 333 of an elevator system in accordance with an embodiment of the present disclosure is shown. Although shown and described herein as a key-type "access device," the term "access device" may refer to any access key, tool, or other mechanism that can be used to lock/unlock an elevator landing door. As shown, the lock 333 is an elevator door lock located within a landing door lintel 329 or landing door column of an elevator doorway. The access device 331 is configured to fit within an aperture or keyway of the lock 333. Those of skill in the art will appreciate that the locks and keys described herein are not limited to door locks, but rather may be employed in any locks of elevator systems. For example, in other configurations, the lock may be part of a door column or trap inside an elevator car or may be a lock of other parts of elevator systems. Thus, FIG. 3 is merely illustrative and not intended to be limiting. The lock 333 can include access prevention devices or mechanisms configured within the lock 333 to prevent the access device 331 from entering the aperture of the lock 333. The access device 331 is specifically designed for engagement and use with the specific lock 333.

As provided herein, embodiments of the present disclosure are directed to access devices that are arranged to prevent unauthorized access to an elevator shaft. In accordance with some embodiments, a single-use access system is provided wherein unauthorized access is prevented and safety measures are maintained.

Figure 4A:
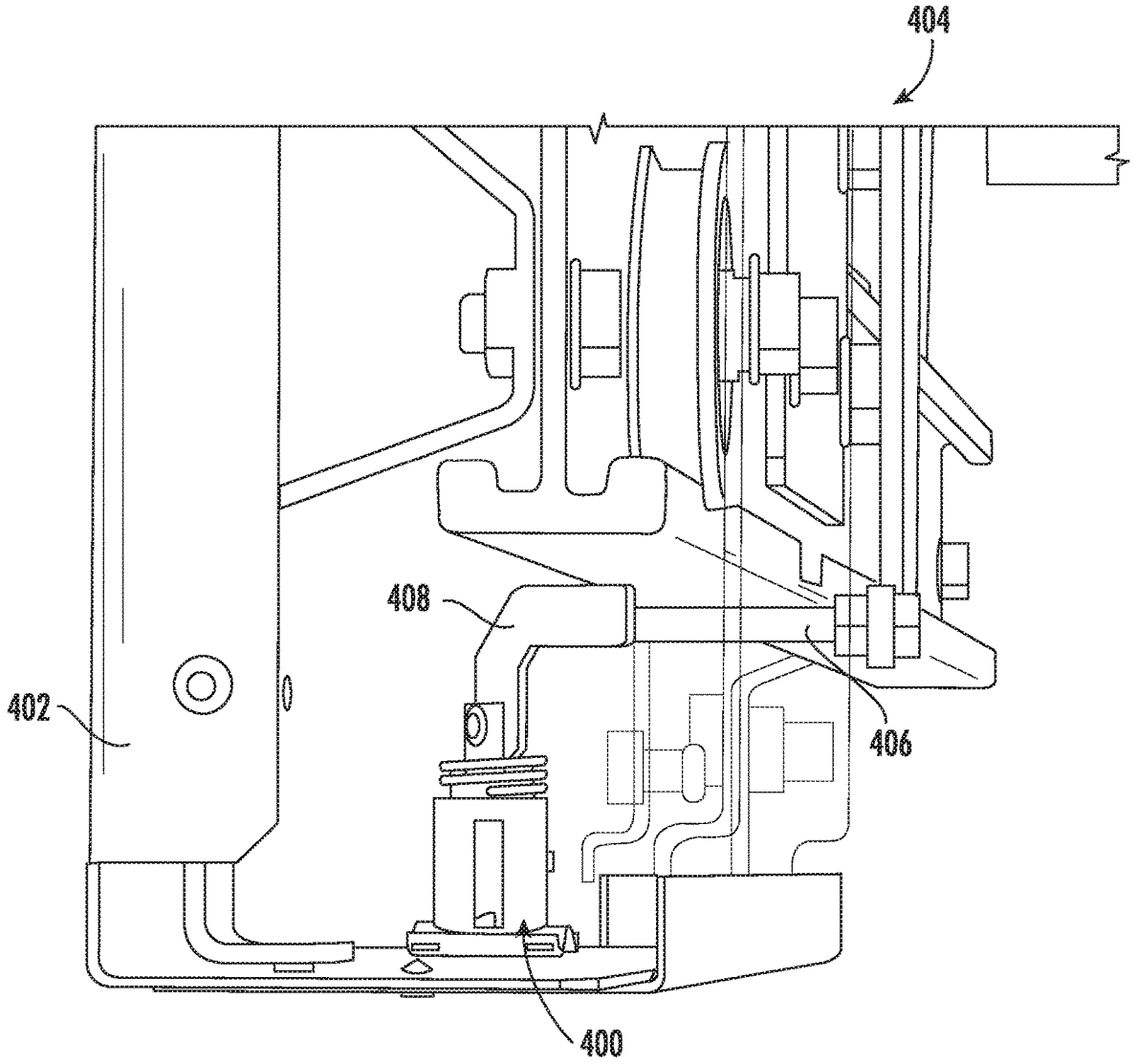
FIG. 4A is a schematic illustration of an elevator access system in accordance with an embodiment of the present disclosure as installed in a lintel of an elevator system.

Turning now to FIGS. 4A-4D, schematic illustrations of an elevator access device 400 in accordance with an embodiment of the present disclosure are shown. FIG. 4A illustrates the elevator access device 400 as installed within a lintel 402 of an elevator system. The lintel 402 houses, in part, a landing door unlocking system 404, as will be appreciated by those of skill in the art. As shown, the landing door unlocking system 404 includes a lock pin 406 that is arranged to unlock a landing door, as will be appreciated by those of skill in the art. The lock pin 406 is positioned to be engaged by a lever 408 of the elevator access device 400.

Figure 4B:
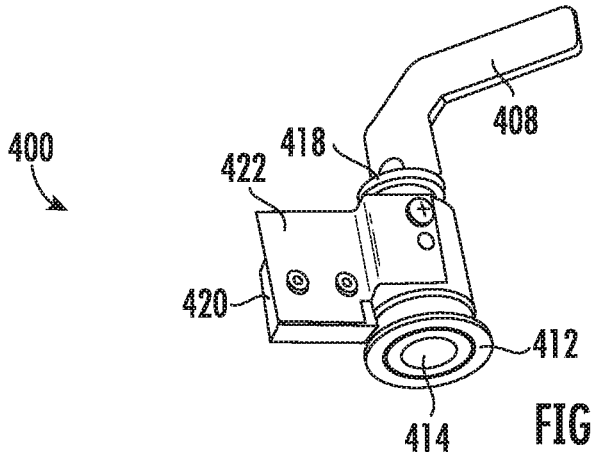
FIG. 4B is an isometric illustration of the elevator access system of FIG. 4A shown in isolation.
Figure 4C:
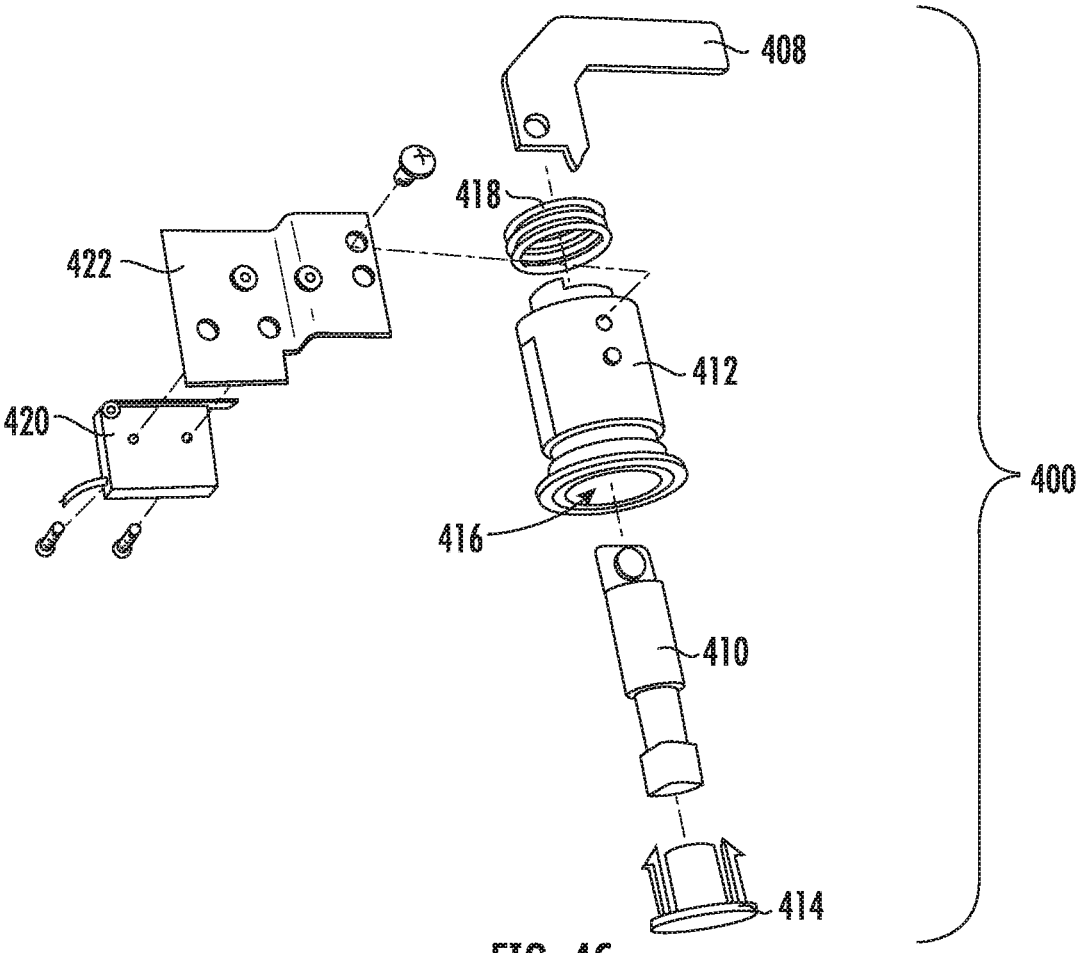
FIG. 4C is an exploded illustrative view of the elevator access system of FIG. 4A.

FIG. 4B illustrates the elevator access device 400 in isolation, and FIG. 4C illustrates an exploded view of the elevator access device 400. In this embodiment, the elevator access device 400 includes the lever 408 that is operably connected to a plunger 410 that is contained within a bushing 412. The elevator access device 400 further includes a removable plug 414 positioned within the bushing 412 and arranged to prevent access to and operation of the plunger 410 and thus the lever 408. The plunger 410, in some embodiments, is arranged to receive or engage with a key that is inserted into the bushing 412. However, the removable plug 414 is configured to prevent insertion of a key into the bushing 412 to operate the plunger 410 when the removable plug 414 is intact or present.

The removable plug 414 is arranged to fit within a keyway 416 of the bushing 412. Further, the removable plug 414 is configured to push against the plunger 410 to push the plunger 410 upward within the bushing 412. As the plunger 410 is pushed upward within the bushing 412, a biasing element 418 will be extended. The biasing element 418 is connected to the lever 408 and arranged to urge the lever 408 in a downward direction (e.g., toward the bushing 412). As such, when the removable plug 414 is installed within the bushing 412, the removable plug 414 will urge the plunger 410 to push the lever 408 upward such that it cannot be used to operate a landing door lock. However, if the removable plug 414 is removed, the plunger 410 may move within the bushing 412 and the biasing element 418 will urge the lever 408 downward into a position to enable operation of a landing door lock.

As shown in FIGS. 4B-4C, the elevator access device 400 further includes an (optional) elevator safety chain switch 420 and a switch cover 422. The elevator safety chain switch 420 is electrically connected to an elevator safety chain such that operation of the elevator safety chain switch 420 will break the elevator safety chain, and thus prevent normal operation of the elevator system, as will be appreciated by those of skill in the art. In some embodiments, the plunger 410 is arranged to actuate the elevator safety chain switch 420 when the plunger 410 is moved within the bushing 412, after removal of the removable plug 414. The switch cover 422 is arranged to securely mount the elevator safety chain switch 420 to the bushing 412, as shown.

Figure 4D:
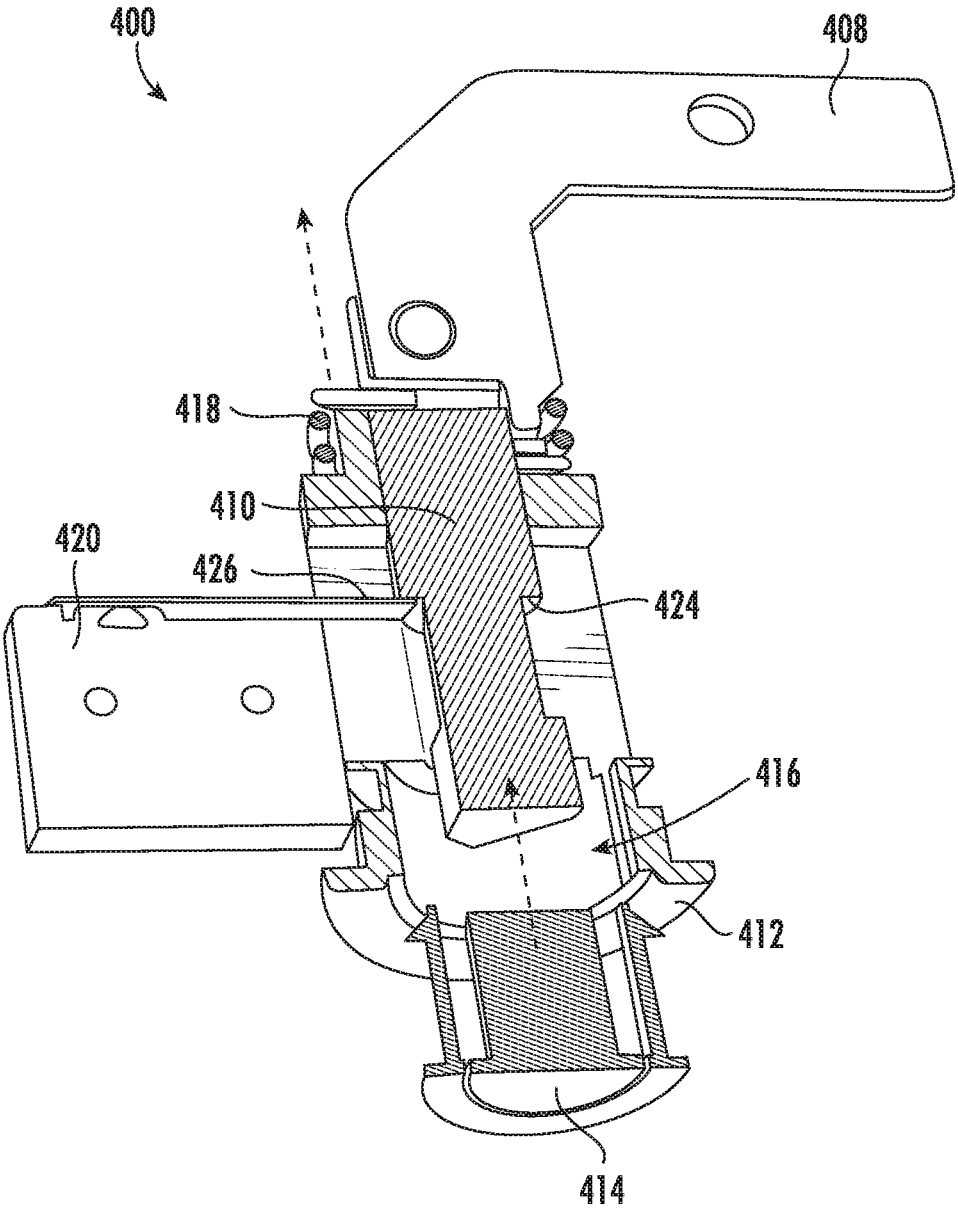
FIG. 4D is a schematic illustration of an operation of the elevator access system of FIG. 4A.

FIG. 4D illustrates installation of the removable plug 414 to the elevator access device 400. The removable plug 414 is inserted into the keyway 416 of the bushing 412, and the removable plug 414 will contact and move the plunger 410 within the bushing 412. As the plunger 410 is moved within the bushing 412, the plunger 410, which is operably connected to the lever 408, will urge the lever upward into a first position. Such action will extend the biasing element 418. When the removable plug 414 (or a portion thereof) is removed, the biasing element will urge the lever 408 and the plunger 410 into a second position. In the second position, the plunger 410 is accessible to be operated by a key, such as that shown in FIG. 3. Further, in the second position, the lever 408 will be aligned with the lock pin 406 (shown in FIG. 4A) to enable unlocking of a landing door. Further, when the plunger 410 moves into the second position, a contact surface 424 of the plunger 410 will contact a switch arm 426 to thus trigger (or break) an elevator safety chain by actuation of the elevator safety chain switch 420.

Turning now to FIGS. 5A-5G, schematic illustrations of operation of an elevator access device 500 in accordance with an embodiment of the present disclosure are shown. The elevator access device 500 is similar to that shown and described with respect to FIGS. 4A-4D, and thus detailed description may not be repeated. The elevator access device 500 is installable within a lintel of an elevator landing and is arranged to enable access and operation of a landing door lock.

Figure 5D:
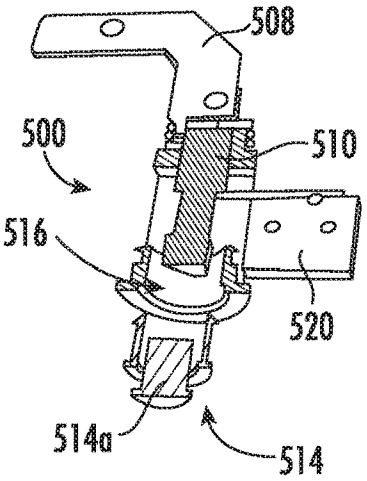
FIG. 5D is a schematic illustration of the elevator access system of FIG. 5A illustrating part of an operation of the elevator access system.
Figure 5C:
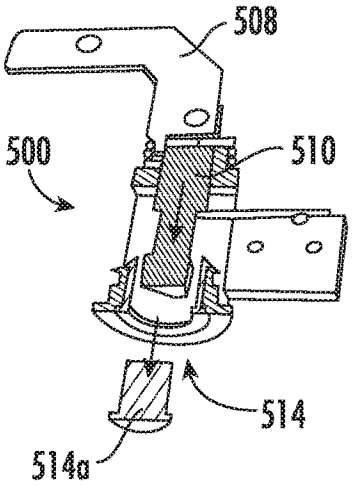
FIG. 5C is a schematic illustration of the elevator access system of FIG. 5A illustrating part of an operation of the elevator access system.
Figure 5B:
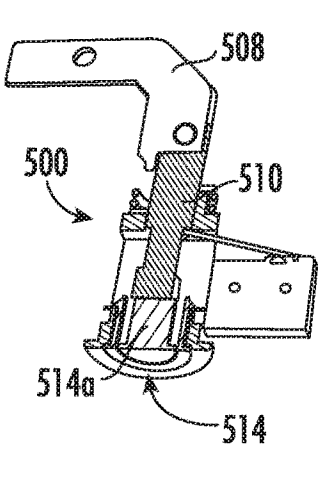
FIG. 5B is a schematic illustration of the elevator access system of FIG. 5A illustrating part of an operation of the elevator access system.
Figure 5A:
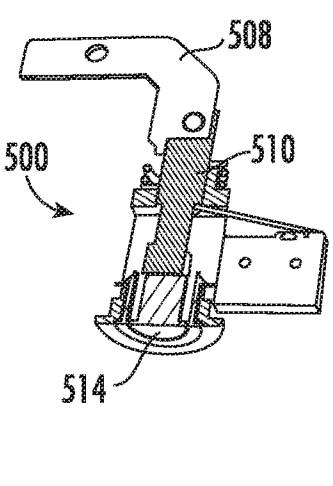
FIG. 5A is a schematic illustration of an elevator access system in accordance with an embodiment of the present disclosure, shown in a first position.

FIG. 5A illustrates the elevator access device 500 in a first position, with a removable plug 514 engaged to urge a plunger 510 and a lever 508 into the first position. The removable plug 514 prevents access to the plunger 510 and thus prevents operation of the landing door lock.

FIG. 5B illustrates that a removable portion 514*a* of the removable plug 514 is broken or separated from the removable plug 514, thus enabling removal of the removable portion 514*a*. The removable portion 514*a* can be the portion of the removable plug 514 that engages with and contacts the plunger 510. Thus, by removing the removable portion 514*a*, the plunger 510 may move within the elevator access device 500.

FIG. 5C illustrates the removal of the removable portion 514*a* and further illustrates the relative movement of the plunger 510 within the elevator access device 500. As the plunger 510 moves from the first position toward the second position, the plunger 510 will contact and actuate an elevator safety chain switch 520.

Figure 5G:
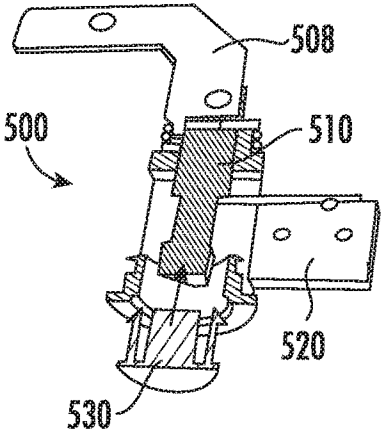
FIG. 5G is a schematic illustration of the elevator access system of FIG. 5A illustrating part of an operation of the elevator access system, installing a new removable plug therein.
Figure 5F:
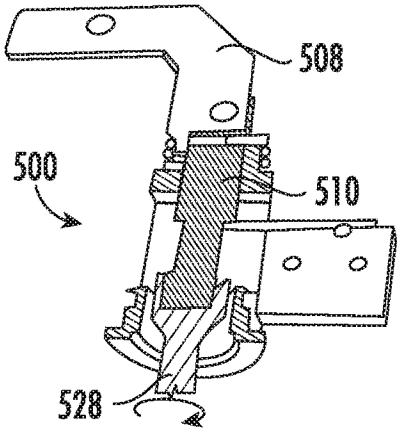
FIG. 5F is a schematic illustration of the elevator access system of FIG. 5A illustrating part of an operation of the elevator access system.
Figure 5E:
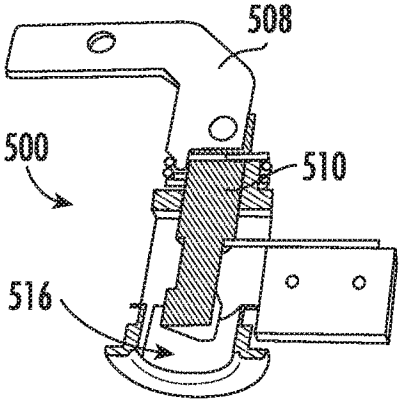
FIG. 5E is a schematic illustration of the elevator access system of FIG. 5A illustrating part of an operation of the elevator access system, showing the elevator access system in a second position.

As shown in FIGS. 5D-5E, the entirety of the removable plug 514 can be removed from a keyway 516 of the elevator access device 500. With the removable plug 514 removed, access to the plunger 510 and operation thereof is possible.

Accordingly, as shown in FIG. 5F, a key 528 is shown inserted into the elevator access device 500 and engaging with the plunger 510. The key 528 can be used to rotate the plunger 510 and thus rotate the lever 508 to enable unlocking of a landing door of an elevator system. Thus, a mechanic or other authorized person can perform a maintenance operation (or other action).

Because the safety chain is broken by actuation of the elevator safety chain switch 520 of the elevator access device 500, it is impossible to operate the elevator system in normal operation mode until the elevator access device 500 is repaired or replaced.

For example, as shown in FIG. 5G, a new plug 530 can be inserted into the elevator access device 500. The new plug 530 will contact and urge the plunger 510 upward and back into the first position. As this movement occurs, the elevator safety chain switch 520 may be actuated such that the elevator safety chain is returned to the normal run or operating state (e.g., recompleting, reconnecting the elevator safety chain). That is, by inserting the new plug 530, the elevator safety chain switch 520 may be reset to enable normal operation of the elevator system.

In accordance with embodiments of the present disclosure, the elevator access device has, in some embodiments, a breakable plastic plug to enable access to an unlocking plunger to open a landing door. Once the plug is broken, as described above, the safety chain is open and switched over to the ground. Having the safety chain switched over to the ground in addition to be open is safer because it gives the system the information that a landing is open even if the safety chain is already open at another level. Moreover, advantageously, embodiments provided herein may make it mechanically impossible to access the unlocking plunger and have the safety chain close because of the bushing design and the position of the elevator access device in the lintel. That is, to have access to the unlocking plunger, the plug must be broken and the plunger needs to be in lower (second) position. If not, it is impossible to unlock the door because the unlocking plunger is not accessible and the lever will be blocked and thus cannot operate the landing door lock. To put back the elevator in normal mode, a new plug must be installed, the landing door closed, and the system reset.

Figure 6A:
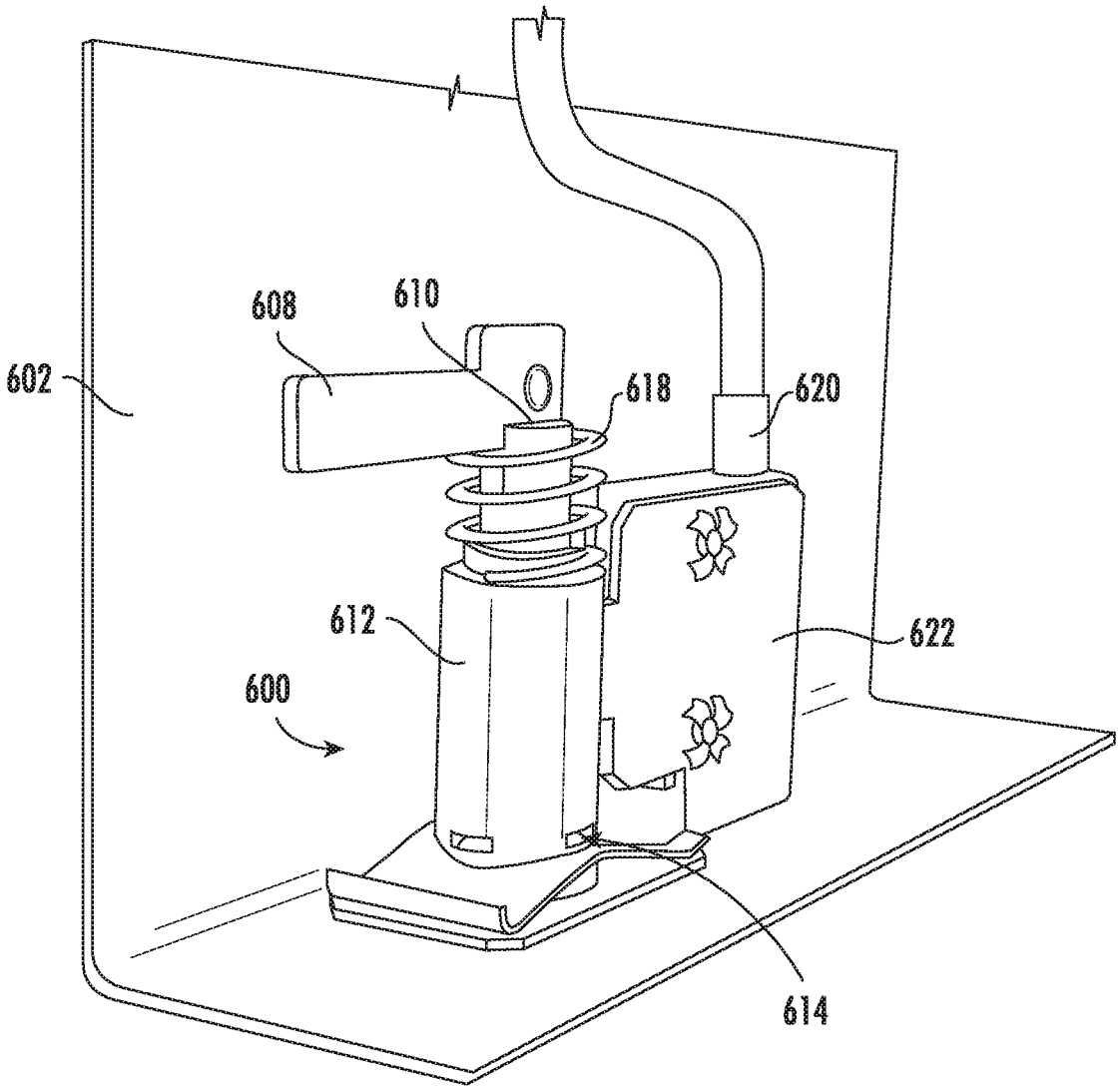
FIG. 6A is a schematic illustration of an elevator access system in accordance with an embodiment of the present disclosure.
Figure 6B:
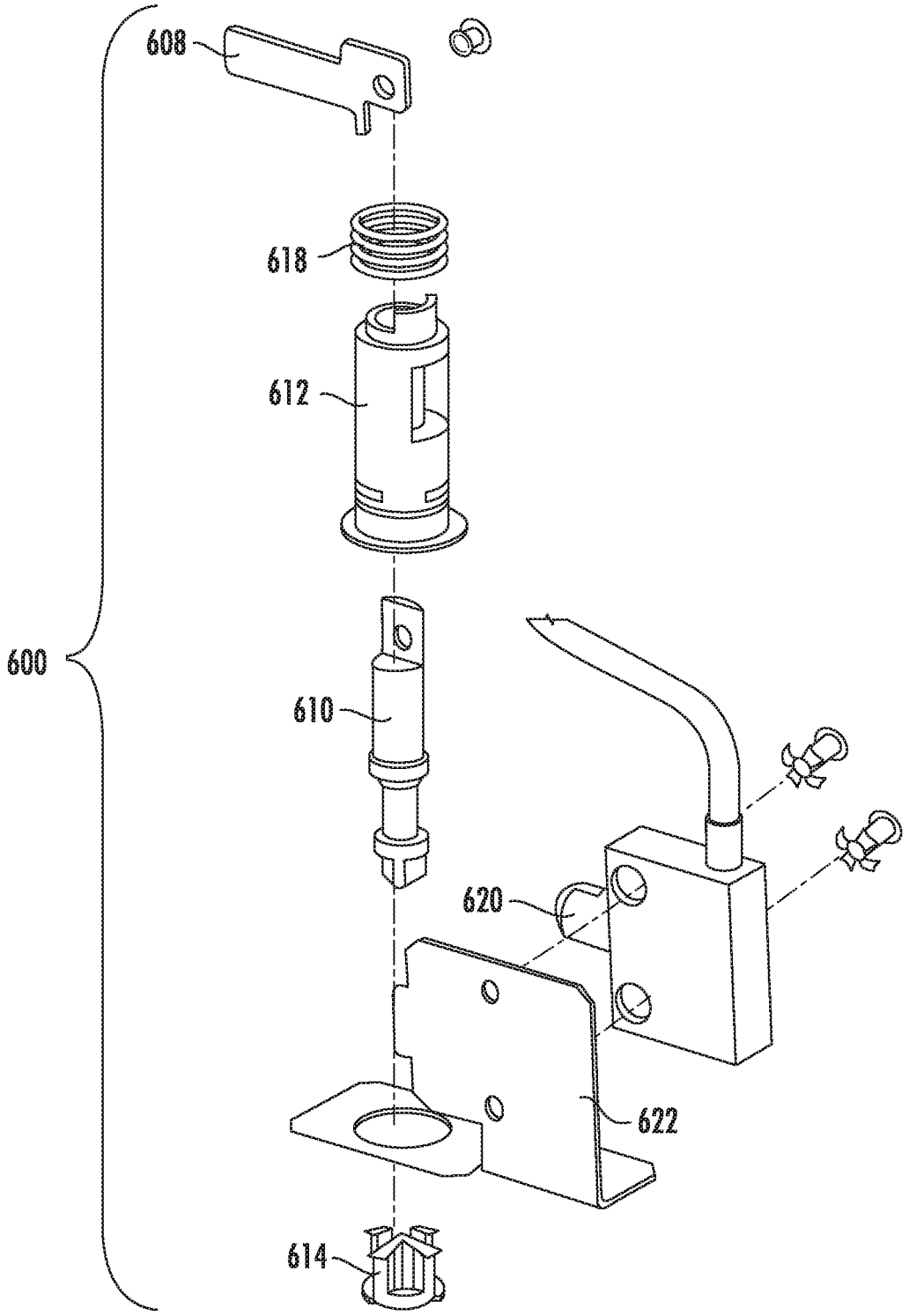
FIG. 6B is an exploded view illustration of the elevator access system of FIG. 6A.

Turning now to FIGS. 6A-6B, an elevator access device 600 in accordance with an embodiment of the present disclosure is shown. The elevator access device 600 may be similar to that described above, and thus similar features may not be described again in detail. FIG. 6A is a schematic illustration of the elevator access device 600 as installed to a lintel 602 and FIG. 6B is an exploded view of the elevator access device 600.

As shown, the elevator access device 600 includes a bushing 612 that houses a plunger 610 and a removable plug 614, with the removable plug 614 being accessible and breakable from an exterior of the lintel 602. The plunger 610 is operably connected to a lever 608 that can contact a locking pin of a landing door to unlock the landing door, when in a second position. However, as noted above, the removable plug 614, when present, will urge the plunger 610 and the lever 608 into a first position wherein operation of a landing door lock is not possible.

An elevator safety chain switch 620 is mounted to the bushing 612 by a switch cover 622. When the plunger 610 is moved within the bushing 612, after removal of the removable plug 614 (or when a new plug is inserted), the plunger 610 will actuate the elevator safety chain switch 620, thus breaking (or re-connecting) an elevator safety chain, as will be appreciated by those of skill in the art.

As shown in FIG. 6B, the elevator access device 600 includes a biasing element 618 that is operably connected to the lever 608. When the plunger 610 is pushed into the first position by a removable plug 614, the plunger 610 will urge the lever 608 into the first position, which will prevent contact between the lever 608 and a lock pin of a landing door lock. When the removable plug 614 (or a portion thereof) is removed, the biasing element 618 will urge the lever 608 downward, applying force to the plunger 610 and moving the plunger 610 within the bushing 612. The lever 608 will move into a second position where it can contact and enable operation of a landing door lock, and the plunger 610 will be accessible to enable operation by insertion of a key into the elevator access device 600. As the plunger 610 is moved from the first position to the second position, it will engage with and actuate the elevator safety chain switch 620.

Figure 7A:
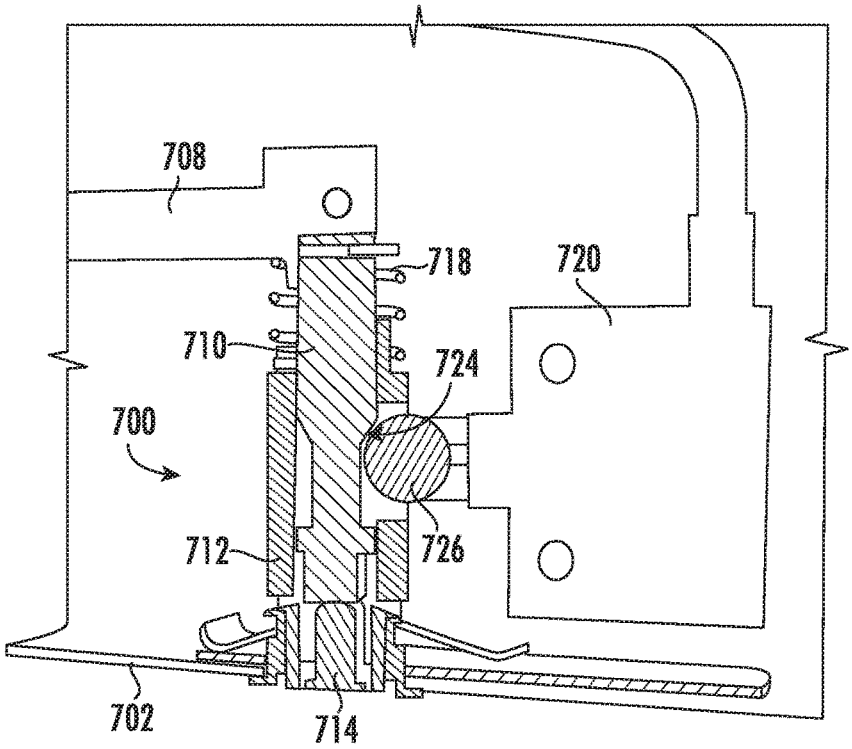
FIG. 7A is a schematic illustration of an operation of an elevator access system in accordance with an embodiment of the present disclosure, shown in a first position.
Figure 7B:
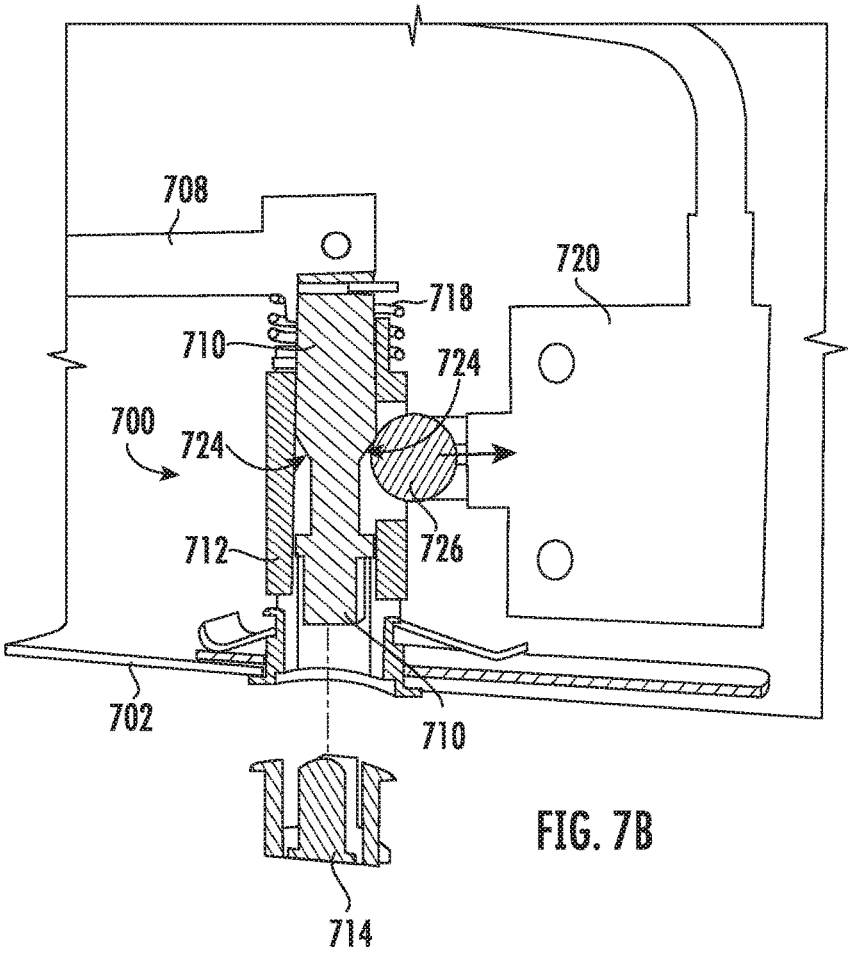
FIG. 7B is a schematic illustration of an operation of the elevator access system of FIG. 7A, shown in a second position.

Turning now to FIGS. 7A-7B, schematic illustrations of operation of an elevator access device 700 in accordance with an embodiment of the present disclosure are shown. The elevator access device 700 is similar to that shown and described with respect to FIGS. 6A-6B. The elevator access device 700 includes a bushing 712 mounted to a lintel 702 with a plunger 710 movable within the bushing 712. A removable plug 714, as shown in FIG. 7A, is installed within the bushing 712 and in contact with the plunger 710 to urge the plunger 710 into a first position, which in turn urges a lever 708 into the first position and extends a biasing element 718.

As shown in FIG. 7B, when the removable plug 714 (or a portion thereof) is removed from the bushing 712, the biasing element 718 will force the lever 708 and the plunger 710 downward (as illustratively shown by the arrows). As the plunger 710 moves from the first position to the second position, a contact surface 724 of the plunger 710 will contact a switch arm 726 to thus trigger (or break) an elevator safety chain by actuation of an elevator safety chain switch 720. Further, in the second position, the plunger 710 is accessible to be engaged by a key to operate the lever 708 and thus unlock a landing door lock.

Figure 8B:
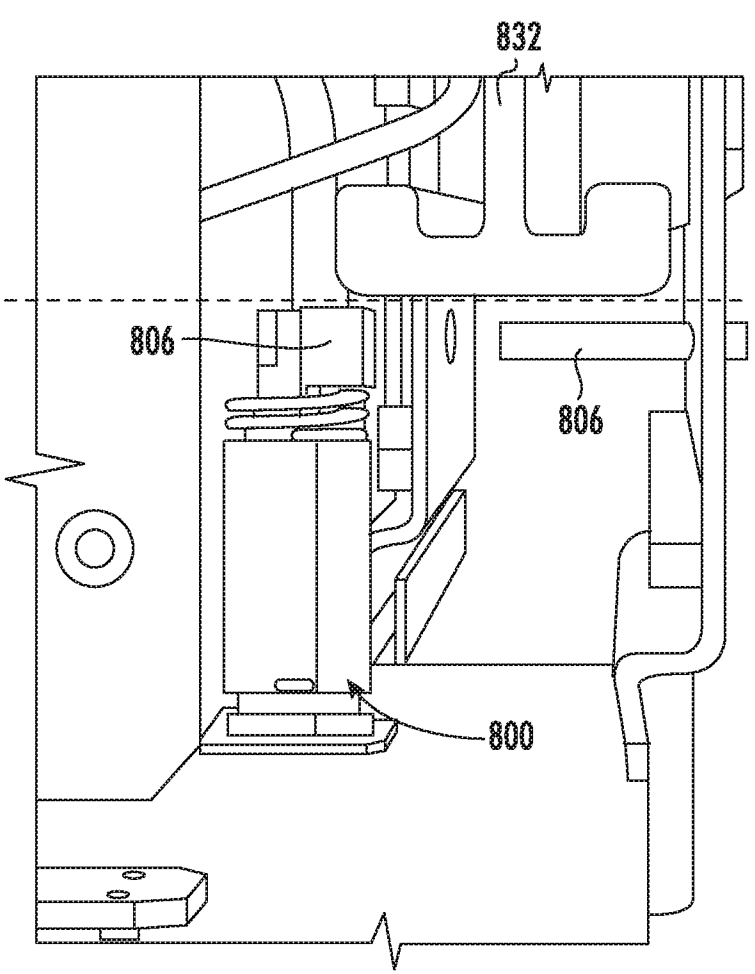
FIG. 8B is a schematic illustration of an operation of the elevator access system of FIG. 8A, shown in a second position.
Figure 8A:
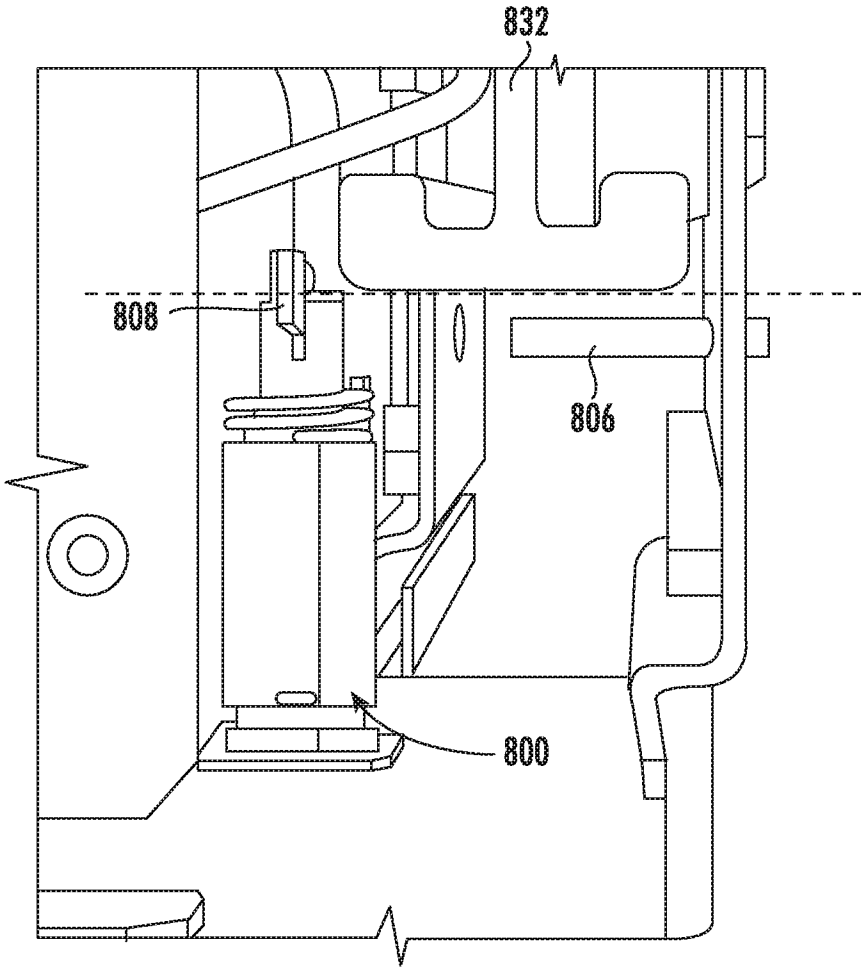
FIG. 8A is a schematic illustration of an operation of an elevator access system in accordance with an embodiment of the present disclosure, shown in a first position.

Turning to FIGS. 8A-8B, schematic illustrations of an elevator access device 800 in accordance with an embodiment of the present disclosure are shown. As noted above, when the elevator access devices are in the first position, the lever is not able to interact with the lock pin of a landing door lock to enable unlocking of the landing door. FIG. 8A illustrates the elevator access device 800 in the first position and FIG. 8B illustrates the elevator access device 800 in the second position.

As shown, in the first position (FIG. 8A), a lever 808 of the elevator access device 800 is in the first position and is blocked by a rail 832 of the elevator system. As such, even if access to a plunger of the elevator access device 800 was achieved, rotation of the lever 808 would not be possible because the movement thereof is blocked by the rail 832. Thus, the lever 808 cannot interact with a lock pin 806.

However, if a plug of the elevator access device 800 is removed, and the plunger and lever 808 are moved to the second position (FIG. 8B), the lever 808 is no longer blocked by the rail 832. As such the lever 808 is free to rotate and contact the lock pin 806 and operate the landing door lock.

Advantageously, embodiments provided herein are directed to single-use elevator access devices, particularly devices arranged to enable operation of landing door locks of elevator systems. Breakable or frangible plugs are provided to both block access to a plunger and also to urge a lever into a position wherein it cannot be used to unlock a landing door.

As used herein, the use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator access system comprising:

a bushing having a keyway;

a plunger disposed within the bushing and movable relative thereto;

a lever operably connected to the plunger; and a removable plug located within the keyway of the bushing, wherein the removable plug urges the plunger and the lever into a first position, and upon removal of the removable plug, the plunger and the lever move to a second position, wherein in the second position the plunger is accessible to operate the lever.

2. The elevator access system of claim 1, further comprising an elevator safety chain switch, wherein when the plunger moves from the first position to the second position, the elevator safety chain switch is actuated to break an elevator safety chain.

3. The elevator access system of claim 2, further comprising a switch cover arranged to mount the elevator safety chain switch to the bushing.

4. The elevator access system of wherein the plunger has a contact surface and the elevator safety chain switch has a switch arm, wherein as the plunger moves from the first position to the second position, the contact surface contacts the switch arm to actuate the elevator safety chain switch.

5. The elevator access system of claim 1, further comprising a biasing element operably connected to the lever, wherein the biasing element is arranged to urge the lever toward the second position.

6. The elevator access system of claim 3, wherein the plunger has a contact surface and the elevator safety chain switch has a switch arm, wherein as the plunger moves from the first position to the second position, the contact surface contacts the switch arm to actuate the elevator safety chain switch.

7. The elevator access system of claim 2, further comprising a biasing element operably connected to the lever, wherein the biasing element is arranged to urge the lever toward the second position.

8. The elevator access system of claim 3, further comprising a biasing element operably connected to the lever, wherein the biasing element is arranged to urge the lever toward the second position.

9. The elevator access system of claim 4, further comprising a biasing element operably connected to the lever, wherein the biasing element is arranged to urge the lever toward the second position.

10. An elevator system comprising:

an elevator shaft having a plurality of landings; and an elevator system located at at least one of the plurality of landings, the elevator access system having a bushing a keyway, a plunger disposed within the bushing and movable relative thereto, a lever operably connected to the plunger, and a removable plug located within the keyway of the bushing, wherein the removable plug urges the plunger and the lever into a first position, and upon removal of the removable plug, the plunger and the lever move to a second position, wherein in the second position the plunger is accessible to operate the lever.

11. The elevator system of claim 10, wherein the bushing is installed in a landing door lintel of the elevator system.

12. The elevator system of claim 10, further comprising a landing door lock having a lock pin, wherein the lever is arranged to contact the lock pin when in the second position.

13. The elevator system of claim 10, further comprising a rail, wherein when the lever is in the first position, the rail blocks rotational movement of the lever.

14. The elevator system of claim 11, further comprising a landing door lock having a lock pin, wherein the lever is arranged to contact the lock pin when in the second position.

15. The elevator system of claim 11, further comprising a rail, wherein when the lever is in the first position, the rail blocks rotational movement of the lever.

16. The elevator system of claim 12, further comprising a rail, wherein when the lever is in the first position, the rail blocks rotational movement of the lever.

* * * * *